US007519308B2

(12) United States Patent
Bracken et al.

(10) Patent No.: US 7,519,308 B2
(45) Date of Patent: Apr. 14, 2009

(54) DEVICE AND METHOD FOR REMOVING IMAGE FORMING SUBSTANCE DEPOSITS

(76) Inventors: Peter Wallace Bracken, 4284 Southmoor Park, Lexington, KY (US) 40514; Donn Duane Bryant, 1850 Bellefonte Dr., Lexington, KY (US) 40503; Scott Richard Castle, 704 Everest Ct., Lexington, KY (US) 40515; Kevin Scott Kennedy, 1109 Claridge Dr., Lexington, KY (US) 40504; Abigail Susanne Marsh, 2717 Crystal Falls Rd., Lexington, KY (US) 40509; David Lawrence Peter, 2000 Blackhorse La., Lexington, KY (US) 40503; Donald Wayne Stafford, 502 Crumbaugh Rd., Georgetown, KY (US) 40324

( * ) Notice: Subject to any disclaimer, the term of this patent is extended or adjusted under 35 U.S.C. 154(b) by 33 days.

(21) Appl. No.: 11/461,819

(22) Filed: Aug. 2, 2006

(65) Prior Publication Data

US 2008/0038009 A1 Feb. 14, 2008

(51) Int. Cl.
*G03G 21/00* (2006.01)

(52) U.S. Cl. ..... 399/99; 399/98

(58) Field of Classification Search ..... 399/98, 399/99, 114, 326, 327, 343, 347
See application file for complete search history.

(56) References Cited

U.S. PATENT DOCUMENTS

| | | | | |
|---|---|---|---|---|
| 5,218,410 | A * | 6/1993 | Nakabayashi et al. | 399/326 |
| 5,227,844 | A * | 7/1993 | Bhattacharjee et al. | 399/99 |
| 6,845,225 | B2 * | 1/2005 | Toyoda et al. | 399/327 |
| 7,248,812 | B2 * | 7/2007 | Tombs | 399/98 |

* cited by examiner

*Primary Examiner*—Sandra L Brase
(74) *Attorney, Agent, or Firm*—Steven J. Grossman PL

(57) ABSTRACT

The present disclosure relates to a device and method for removal of image forming deposits between two contacting surfaces in an image forming device or image forming device cartridge. The method includes positioning an insert between the contacting surfaces which insert is capable of removing the deposits when the insert is inserted or removed from the device. The deposits may include those that may ultimately adhere or weld to the surfaces of the device during shipping and/or storage and upon exposure to differential environmental conditions.

26 Claims, 7 Drawing Sheets

DEVICE AND METHOD FOR REMOVING IMAGE FORMING SUBSTANCE DEPOSITS

FIELD OF THE INVENTION

The present disclosure relates to a device and method for removing image forming substances deposits. Such deposits may occur between two opposing surfaces that may be in contact in an image forming apparatus. The two surfaces may include a nip between a roller and blade member and the image forming substances may be toner. The image forming apparatus may include an electrophotographic device, ink printer, copier, fax, all-in-one device, multi-functional device or a cartridge suitable for use in any of those devices.

BACKGROUND

An image forming device, such as an electrophotographic device, ink printer, copier, fax, all-in-one device or multi-functional device may use an image forming substance such as toner or ink, which may be stored in a cartridge and may be disposed on media to form an image. The image forming substance, such as toner, may be fixed to the media using an image fixing apparatus, which may apply heat and/or pressure to the roller/blade. When electrophotographic devices, including exchangeable cartridges used in such devices, are stored and/or shipped after manufacture, they may be exposed to temperatures of about 40° C. and above, often for days. The exposure may cause toner to deposit and adhere to the surfaces of the developer roller and/or doctor blade.

SUMMARY OF THE INVENTION

The present disclosure relates in one embodiment to a method for removal of an image forming substance deposit in an image forming device. The image forming device may include two opposing surfaces that are capable of containing such deposit and the method includes positioning an insert between such surfaces wherein the insert is capable of removing the deposit when the insert is inserted or removed from the device. The method may include the additional step of operating the image forming device prior to positioning of the insert, as in, e.g., an image forming testing protocol, and prior to shipment and storage. A user may then remove the insert and proceed to a printing operation.

The present disclosure may also be described as an image forming device comprising two opposing surfaces capable of containing an image forming material deposit. The device may therefore include an insert positioned between such surfaces wherein the insert comprises a material that is capable of removing the deposit when the insert is inserted or removed from the device. The insert may be formed from a material that does not contain volatiles or other contaminants that may be released and/or interfere with any ensuing printing operation. The image forming device may be an image forming device cartridge.

BRIEF DESCRIPTION OF THE DRAWINGS

The above-mentioned and other features and advantages of this invention, and the manner of attaining them, will become apparent and the invention will be better understood by reference to the following description of embodiments of the invention taken in conjunction with the accompanying drawings, wherein.

DETAILED DESCRIPTION

Figure 1:
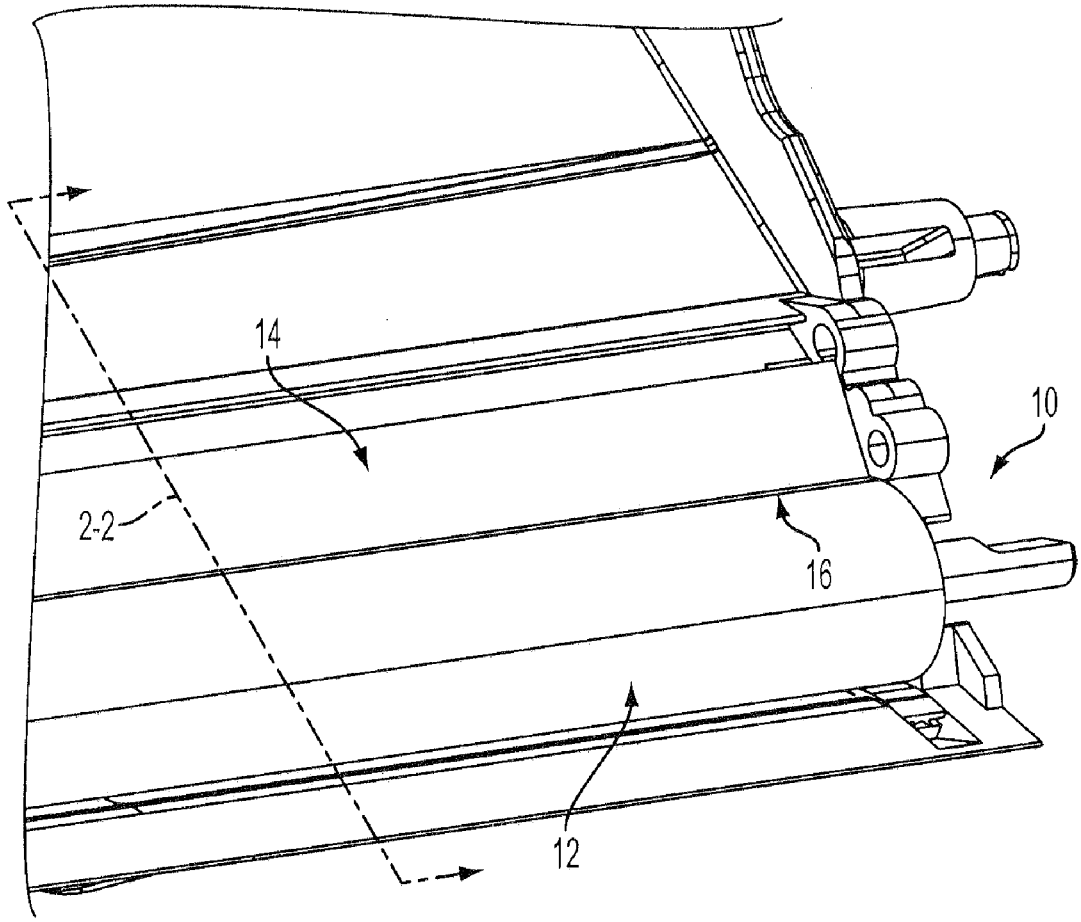
FIG. 1 is a partial front perspective view of a cartridge for an image forming apparatus.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. This invention may be embodied in many different forms and should not be construed as limited to the exemplary embodiments set forth herein.

Figure 2:
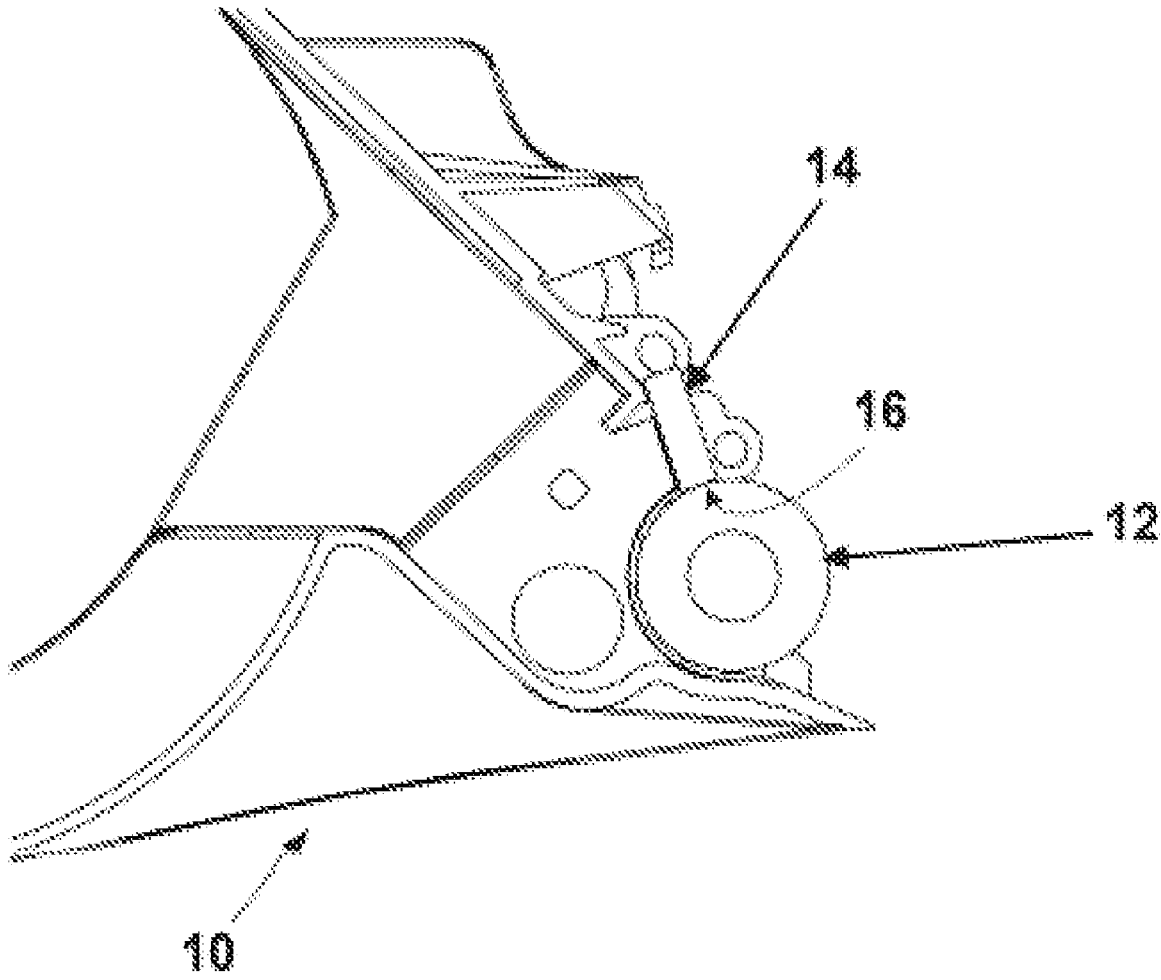
FIG. 2 is a sectional view of the cartridge of FIG. 1 along lines 2-2.

With reference to FIG. 1, a perspective view is provided of a portion of a housing 10 of an exemplary cartridge of an image forming device. The cartridge may be of the replaceable or exchangeable type and may contain an image forming substance such as toner for forming images in an image forming apparatus. Such toner may include conventional toner manufactured by a milling procedure or chemically produced toner (CPT) which may be formed by an emulsion or even suspension type polymerization procedure. A developed roller 12 may cooperate with a doctor blade 14 to provide the toner to a sheet of media. A nip location may be seen generally at 16. FIG. 2 is a sectional view of FIG. 1 along lines 2-2 illustrating the relative positions of the doctor blade 14 and developer roller 12. The nip can again be seen at 16.

The nip may therefore be understood as any region between two opposing surfaces that are relatively close together and which may come in contact. A nip may therefore exist as between the surfaces of the developer roller 12 and doctor blade 14. In that context a nip may exist at other locations within an image forming device such as between two rollers or even between a stationery component and a moving component. A nip may therefore also be found between any two surfaces that are spaced apart and which accommodate the passage of a sheet of media upon which an image may ultimately be formed.

It may therefore be appreciated that as cartridges and/or image forming devices including toner are manufactured and tested prior to shipment, toner may come in contact with the developer roller 12 or doctor blade 14 and reside in the nip location 16 and form a deposit. Accordingly, reference to a toner deposit as being contained on the two opposing surfaces that may form the nip may be understood as toner being present on one of the surfaces, toner being present on both of the surface, or toner existing between the surfaces under consideration. In the event that these cartridges or devices become exposed to elevated temperatures during shipment or storage such toner deposit may weld or adhere to the surface of the roller 12 and/or blade 14. Such welding may also be more likely to occur in the nip due to contact pressure between the roller and blade surfaces. Such temperatures may be at or above about room temperature (25° C.) and may particularly take place at temperature at or above about 40° C. It may therefore be appreciated that such temperatures where toner may deposit and weld may be a function of the type of image forming substance and its associated thermal transition temperatures. For example, in the case of toner containing a polymeric binder, such temperatures may be at or above the glass transition temperature (Tg). Such temperatures may also be at a temperature between Tg and Tm (in the case of crystalline polymeric material) or between Tg and a temperature wherein the polymeric binder is prone to some level of flow and solidification upon cooling. The presence of such deposits and ensuing weld within the nip may then cause unacceptable print streaks and relatively dark bands in a printed page. This may result in customer complaints and even cartridge returns.

Figure 3:
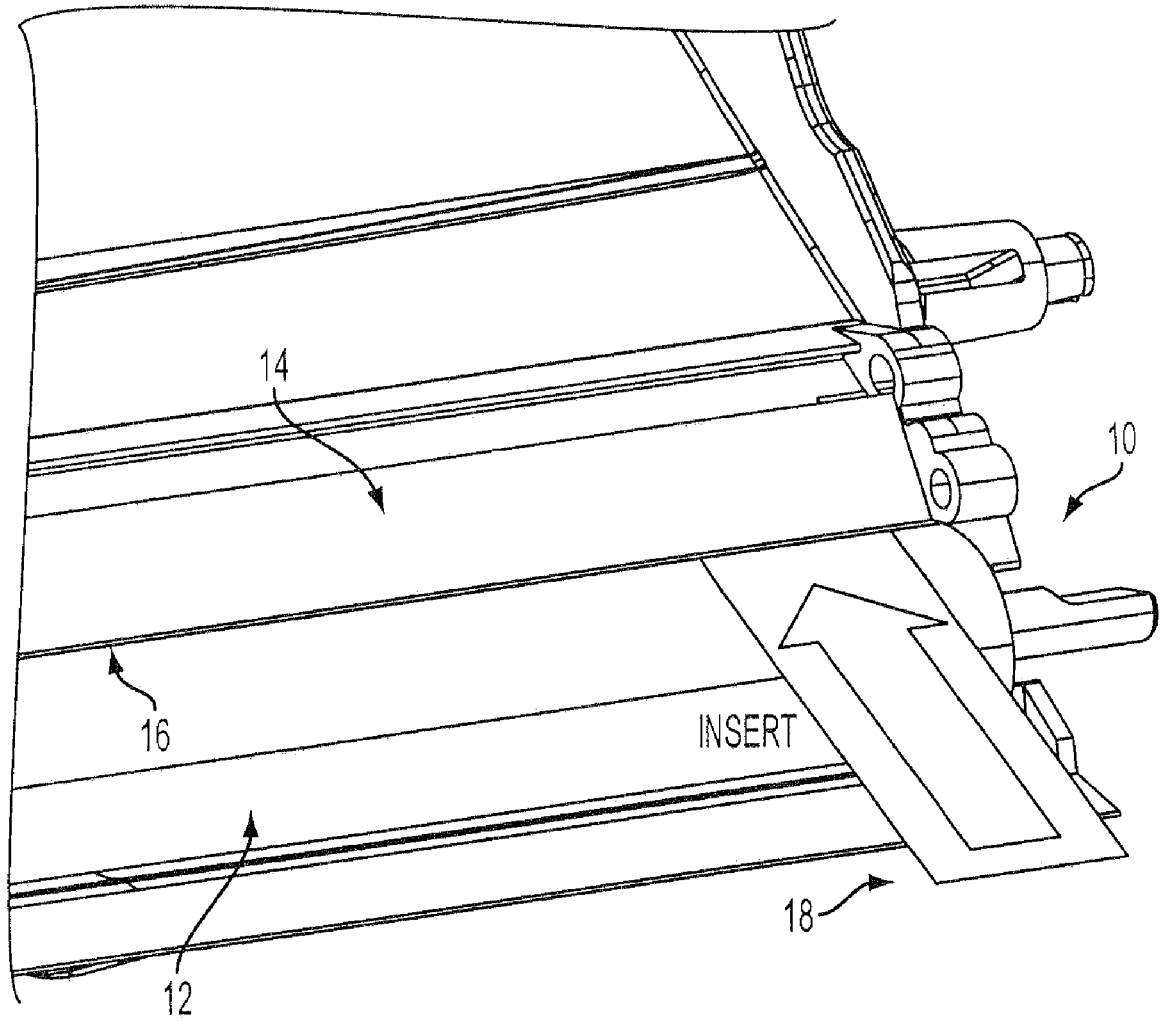
FIG. 3 is a perspective view of an insert being placed between a roller and a blade member.

As shown in FIG. 3 one may insert material 18 into the nip between the blade 14 and roll 12. This may then serve to remove a toner deposit within the nip that may remain after a given print test protocol which may take place prior to shipment and/or storage. It should be appreciated that with respect to FIG. 3, the insert 18 may extend along all or a portion of the contacting surface forming the nip 16. In this manner and upon insertion, all or a portion of image forming substance (e.g. toner) may be removed from the nip which may then prevent fusing or adhering to the doctor blade and developer roller surfaces due to ambient heat and/or pressure. In addition, the insert material may also act as a protective cover for another component such as the developer roll 12 when the insert is retained in the nip and configured with a sufficient size/area dimension. Accordingly, it may drape and cover all or a portion of the developer roller during shipment and/or storage. The insert material 18 may also serve to collect and/or contain toner that may otherwise escape from the cartridge and present problems when used by the consumer.

Figure 4:
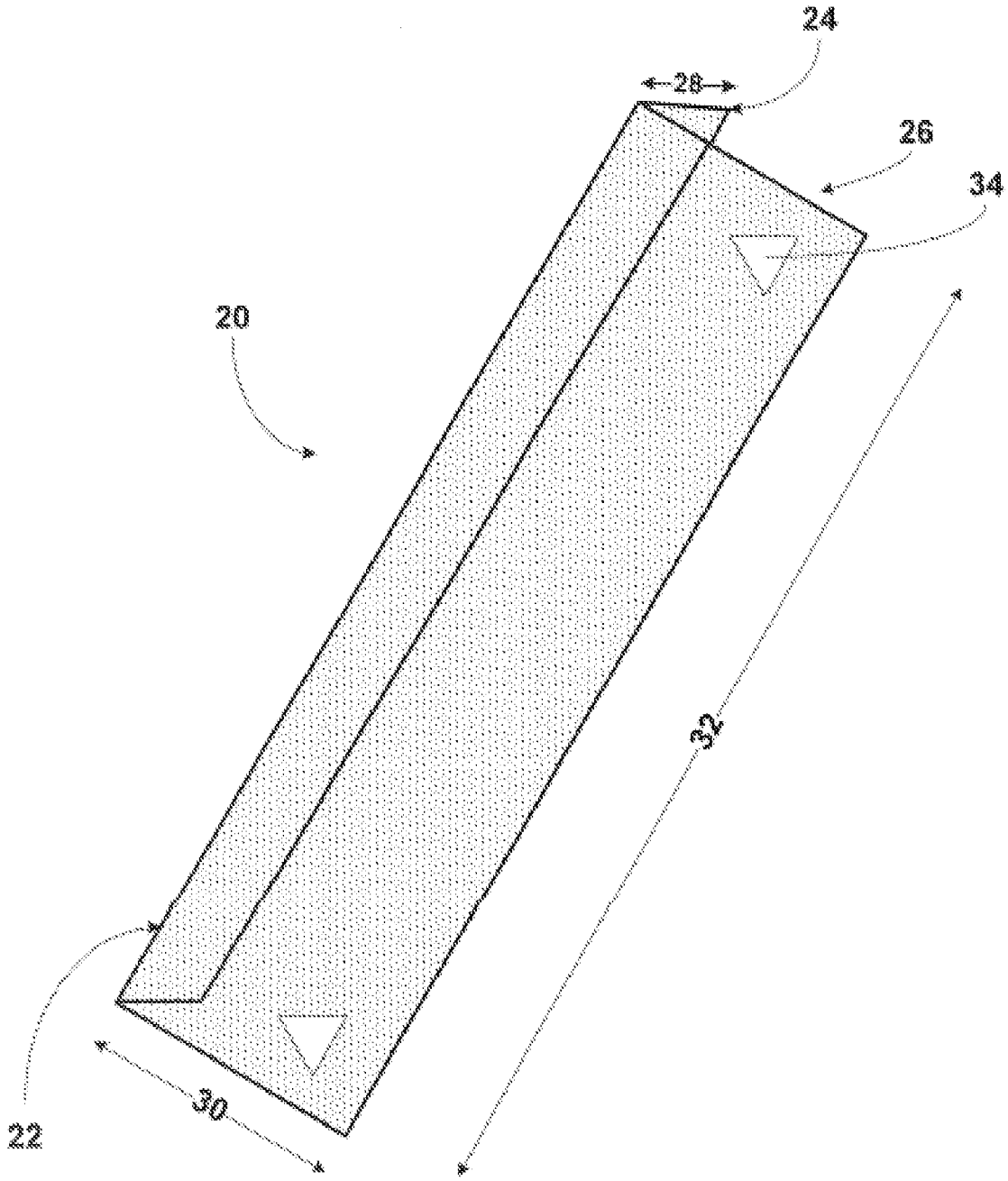
FIG. 4 is another perspective view of an exemplary insert.

FIG. 4 provides an exemplary view of an insert 20 that includes a fold 22 defined by a first section 24 and second section 26. As may be appreciated, the fold 22 may then be inserted into the nip 16 which therefore may operate to avoid the use of an exposed edge section, such as a knife-cut edge, which may be prone to contain loose materials that may separately become lodged in the nip. In addition, as illustrated, the first section 24 may be of a sufficient width 28 to ensure that it extends completely through the nip 16. In addition, the second section 26, as alluded to above, may assume a width 30 that is different than width 28 which may then allow section 26 to cover all or a portion of the roller 12 (see again FIG. 1). It should also be appreciated that other methods may be employed to avoid the use of an exposed edge section such as the use of a sealed edge section wherein the edge section may be thermally treated. For example in the case of a polymer fiber material, one may soften or melt the fibers so that the amount of loose polymeric fibers are reduced. In addition it is contemplated herein that any exposed edge section may be separately coated such that the coating contains and reduces the amount of loose material that may transfer from an exposed edge into the nip location. It is also contemplated herein the any exposed edge section may be bonded to another material which again may similarly reduce the presence and amount of loose materials that might undesirably transfer to the nip section when the insert is installed into the nip prior to shipment and/or storage.

The insert material herein may be preferably formed from a polymeric material and may be provided in sheet or film form which may be compressed when positioned within the nip. It may therefore have an initial thickness of about 0.25 inches or less, including all values and increments between 0.01-0.25 inches. The material may also have sufficient mechanical strength so that it may be inserted into the nip location as generally illustrated in FIG. 3 without resisting insertion and/or folding or crimping prior to being adequately positioned across the entirety of those contacting surfaces forming the nip. However, the present invention also contemplates the use of material that may require assistance when being placed within the nip as more fully described below.

The insert may specifically include a fibrous material, including both woven and/or non-woven fabrics. A non-woven fabric may be understood as a collection of fibers that may be held together by mechanical interlocking (needlepunching), fusing of the fibers as in the case of thermoplastic fibers or by bonding with a binder (e.g. a polymeric binder). More specifically, the non-woven may amount to a thermally bonded material such as a spunbond material wherein polymeric filaments have been extruded, optionally drawn and placed on a moving screen to form a web of material. The non-woven may also include those that may be point-bonded which may be understood as using heat and/or pressure in a desired pattern to bind the fibers to form the non-woven substrate material. One preferred thermally bonded non-woven material includes a non-woven polyester/rayon fabric that contains an acrylic binder, such as STYLE 5203 available from Precision Customer Coatings, Ltd. Rayon is reference to those fibers that may be derived from regenerated cellulose, as well as those fibers composed of regenerated cellulose in which not more than about 15% of the hydrogen atoms of the hydroxyl groups have been substituted. Such non-woven material may have a basis weight of about 20-200 grams/square meter including all values and increments therein. Other polymeric resins that are contemplated herein include polyamides (nylons), polyolefin based materials (e.g., polyethylene and/or polypropylene), acrylic polymers, poly(ethylene terephthalate), polycarbonates, etc.

It is further contemplated that other more specific polymers and/or polymer blends may form the insert. Such polymers and/or polymer blends may include those that do not contain a substantial amount of volatiles that may be otherwise liberated (due to, e.g., thermal conditions) and which may therefore coat on the doctor blade or the developer roller or unfavorably interact with the image forming material (e.g., toner). Such volatiles may include, e.g., residual monomers, oligomers, residual solvent (in the case of a solvent based polymerization) as well as other relatively low molecular weight (MW) additives that may be incorporated into a polymeric material to target a specific property (e.g., a plasticizer). As may be appreciated, such relatively low molecular weight compounds contemplate those particular compounds that may have a MW of less than or equal to about 500 (i.e., $\leqq 500$), including all values and ranges therein. Furthermore, the concentration of such relatively low MW compounds may be at or below about 5.0% by weight (wt.), including all values and increments therein. It should also be understood that the insert may be selected from any suitable material that does not lead to the generation of volatiles under temperature conditions of up to and including about 40° C.

The insert herein may also be one that is selected so that upon insertion into the nip it is capable of frictionally engaging with the contacting surfaces so that any image forming material remaining on the contacting surfaces from a testing operation may be reduced or removed. Accordingly, the insert herein may include a surface texture that facilitates the removal of image forming material and such surface texture may be inherent in the insert materials selected or separately developed on the surface of the insert as may be required. It may therefore be generally understood that such surface texture may ensure that image forming material is efficiently reduced and/or removed from the nip and does not problematically adhere or weld to such contacting surfaces when the image forming device may be stored for excessive periods of time. Furthermore, upon removal from the nip, and as alluded to above, the insert may be selected such that it does not substantially shed any significant material such as some amount of loose fiber and/or particulate that would otherwise remain in the nip and potentially lead to the formation of white streaks on a printed page.

Figure 5:
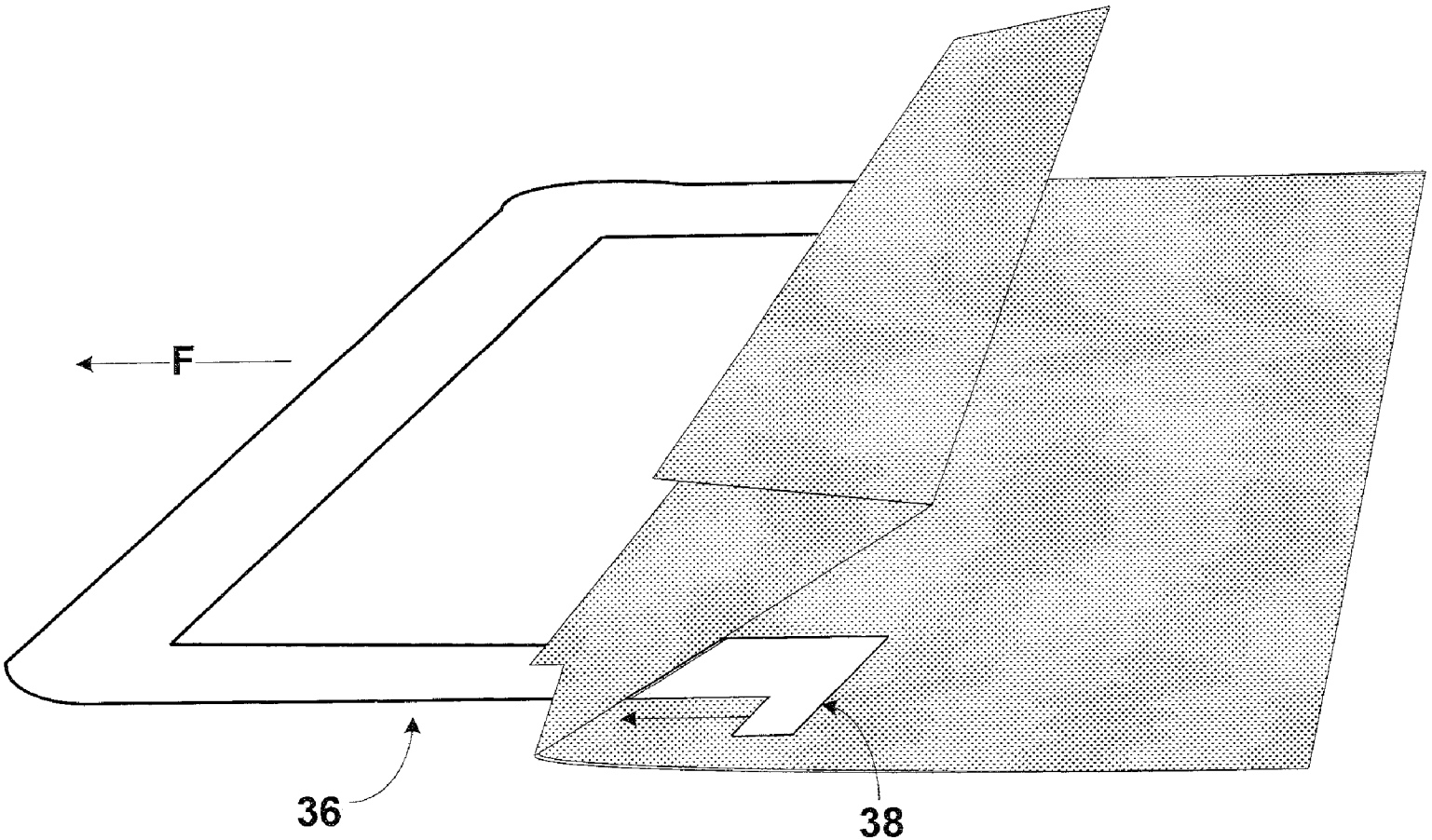
FIG. 5 is a perspective view of an exemplary insert mechanically engaged to a handle.

In addition, as shown in FIG. 4, the insert may be of a length 32 such that it extends along the entire length of the nip region 16 within a given printer cartridge. It may also include two openings 34 which may then accommodate a handle or other type of gripping device which may then facilitate the removal of the insert by an end user. For example, as illustrated in FIG. 5, a handle 36 may include an end section 38 that can be readily inserted in the openings 34 but be of a size greater than the width of the opening 34 such that upon application of a force in the general direction shown at F the end section 38 will mechanically engage with the insert and remove it from the nip location. It may therefore be appreciated that such a design allows for use of a handle 36 that preferably does not require adhesives or some other form of bonding to the insert to aid in its removal, although adhesives may be used. Other techniques for attaching the handle 36 to the insert include mechanical attachment such as through the use of rivets, screws, etc., or other available methods employed to attach a thermoplastic material to, e.g., a given non-woven substrate.

Figure 6:
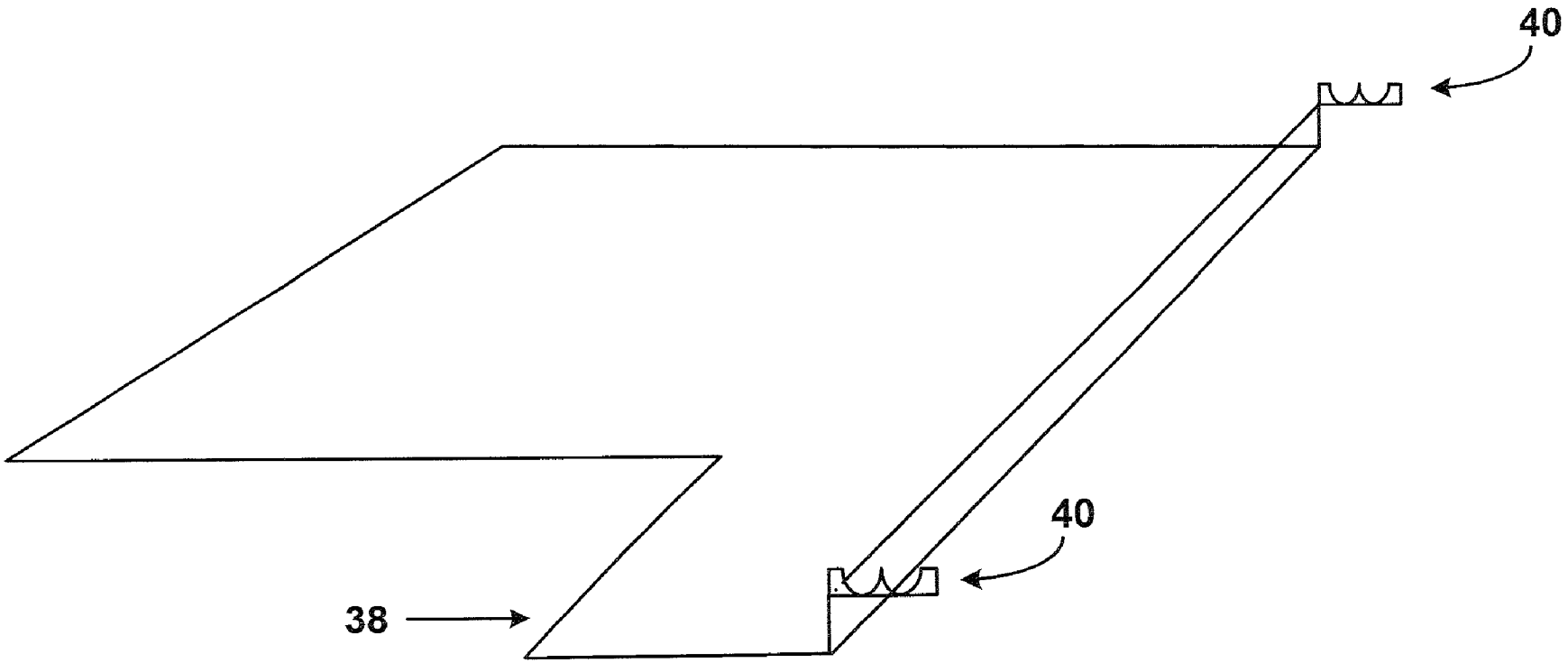
FIG. 6 is a perspective view of one end of the handle illustrating the use of complimentary shaped features to mechanically engage with features on the image forming device cartridge and/or image forming device housing.

In addition, the end section 38 may be configured to include geometric features that allow for mechanical engagement to other portions of the cartridge. For example, end section 38 may be shaped to engage with complimentary shaped features (gears, shafts, bearings, bushings, etc.) at either end of the developer roll 12 in the housing of the cartridge 10. Generally, these features may provide a friction-fit or snap-fit to the complimentary features on the housing 10 and may serve to position and releasably attach the insert to the cartridge 10 during storage and shipment. This is illustrated generally in FIG. 6, which shows that the end section 38 of the handle 36 may contain complimentary features 40 which may engage gears 42 that may be located in the cartridge housing. It may also be appreciated that the end sections 38 may be different on either side to attach to the cartridge or housing as noted above.

Figure 7:
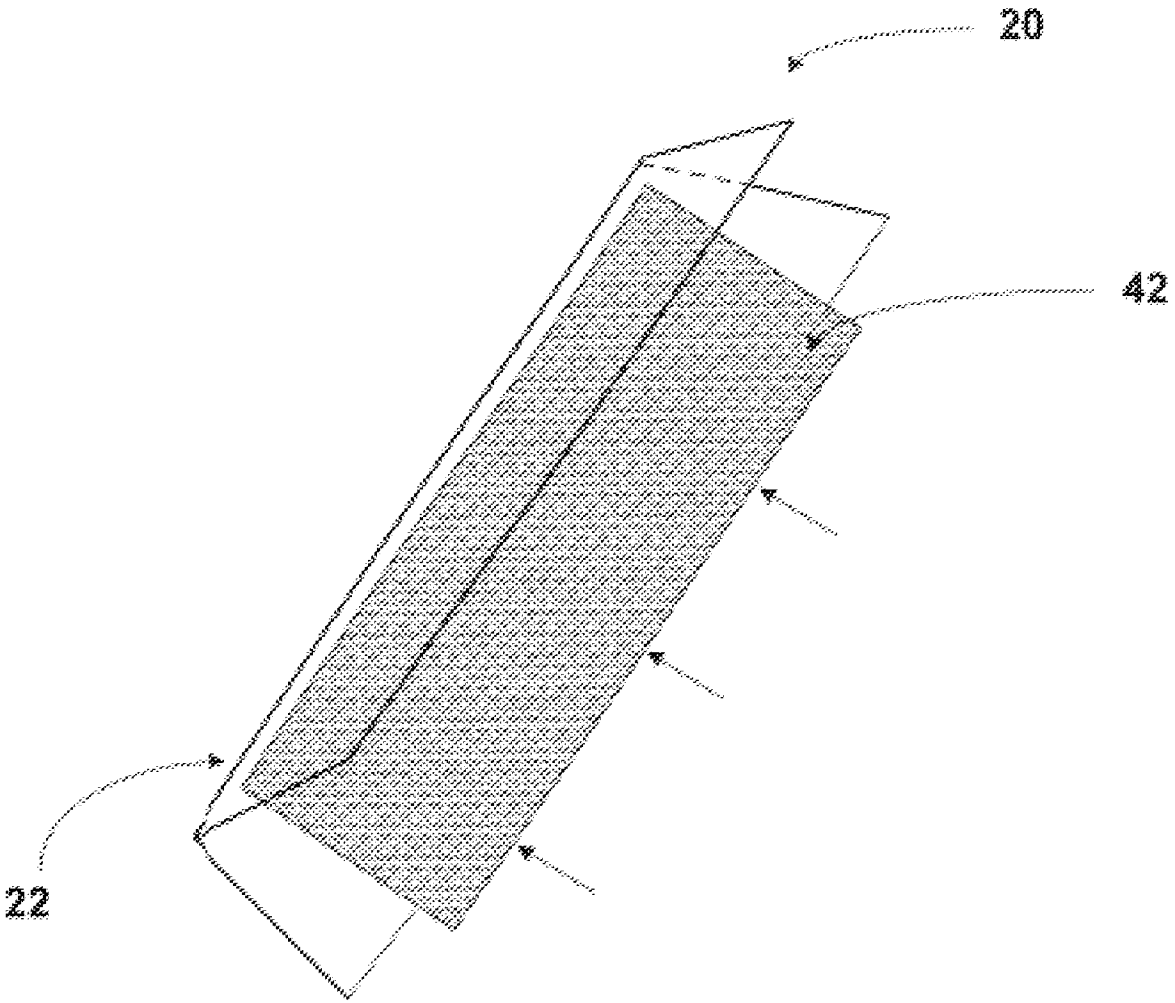
FIG. 7 illustrates one exemplary method for facilitating the placement of an insert into a desired nip location.

In another exemplary embodiment it may be appreciated that one may facilitate placement of the insert 20 into a given nip by providing the insert as shown generally in FIG. 7, containing the fold 22. One may then provide a relatively rigid material 42 (e.g. a thermoplastic type sheet material with a flexural modulus $E_{\beta ex}$ of greater than about 100,000 psi) and position such sheet behind the fold and then proceed to insertion into the nip location with the rigid sheet of material facilitating such placement. Then, once the insert is positioned within the nip the relatively more rigid sheet of material may be removed thereby leaving the relatively less rigid insert in the nip location as desired. The relatively rigid sheet of material utilized to assist in placing, e.g., a non-woven fabric insert into the nip location may rely upon the use of, e.g., a sheet of polyester film such as MYLAR® which may have a thickness of about 0.010-0.020 inches. In addition, the relatively rigid sheet 42 may extend along all or a portion of the fold 22. Furthermore, it is contemplated herein that one may employ a plurality of relatively smaller sized rigid material sections which may be strategically positioned across the inner side of the fold line (see again FIG. 7 wherein rigid material 42 is positioned on the inside surface of the insert that does not engage with the nip surfaces). Such plurality of smaller sized rigid section may then similarly assist in placement of the insert 20 within a nip location and again be readily removed.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for removal of an image forming substance deposit in an image forming device containing two opposing surfaces capable of containing said deposit comprising positioning an insert between said surfaces which insert is capable of removing said deposit when said insert is inserted or removed from said device, wherein said insert comprises first and second sections that are folded to form a fold and said fold is inserted between said opposing surfaces.

2. The method of claim 1 wherein said insert comprises a non-woven fabric material.

3. The method of claim 1 wherein said insert comprises a thermally bonded non-woven fabric material.

4. The method of claim 1 wherein said insert comprises a thermally bonded non-woven having a basis weight of about 20-200 grams/square meter.

5. The method of claim 1 wherein said insert contains less than about 5.0% (wt) of compounds having a molecular weight of less than or equal to about 500.

6. The method of claim 1 wherein said insert includes one or more openings to engage a gripping device.

7. The method of claim 6 wherein said gripping device is capable of mechanically engaging with said image forming device.

8. The method of claim 1 wherein said opposing surfaces are located between a roller and a blade member.

9. The method of claim 8 wherein said insert comprises first and second sections that are folded to form a fold and said fold is inserted between said opposing surfaces and said roller includes an exposed surface and one of said first or second sections of said insert covers a portion of said exposed surface.

10. The method of claim 1 wherein said image forming device comprises an image forming device cartridge.

11. A method for removal of an image forming substance deposit in an image forming device containing two opposing surfaces capable of containing said deposit comprising:

operating said device; and positioning an insert between said opposing surfaces which insert is capable of removing said deposit when said insert is inserted or removed from said device, wherein said insert contains less than about 5.0% (wt) of compounds having a molecular weight of less than or equal to about 500.

12. The method of claim 11 wherein said insert comprises a non-woven fabric material.

13. The method of claim 11 wherein said insert comprises a thermally bonded non-woven fabric material.

14. The method of claim 11 wherein said insert comprises a thermally bonded non-woven having a basis weight of about 20-200 grams/square meter.

15. The method of claim 11 wherein said image forming device comprises an image forming device cartridge.

16. An image forming device comprising:

two opposing surfaces capable of containing an image forming material deposit; and an insert positioned between said surfaces wherein said insert comprises a non-woven material containing less than 5.0% (wt.) of compounds having a molecular weight of less than or equal to about 500, wherein said insert is capable of removing said deposit when said insert is inserted or removed from said device.

17. The image forming device of claim 16 wherein said insert comprises a non-woven fabric material having a basis weight of about 20-200 grams/square meter.

18. The image forming device of claim 16 wherein said device is an image forming device cartridge.

19. The image forming device of claim 16 wherein said insert comprises a thermally bonded non-woven fabric material.

20. The image forming device of claim 16 wherein said insert comprises first and second sections that are folded to form a fold and said fold is inserted between said opposing surfaces.

21. The image forming device of claim 16 wherein said insert includes one or more openings to engage a gripping device.

22. The image forming device of claim 21 wherein said gripping device is capable of mechanically engaging with said image forming device.

23. The image forming device of claim 16 wherein said opposing surfaces are located between a roller and a blade member.

24. The image forming device of claim of claim 23 wherein said insert comprises first and second sections that are folded to form a fold and said fold is inserted between said opposing surfaces and said roller includes an exposed surface and one of said first or second sections of said insert covers a portion of said exposed surface.

25. A method for removal of an image forming substance deposit in an image forming device containing two opposing surfaces capable of containing said deposit comprising positioning an insert between said surfaces which insert is capable of removing said deposit when said insert is inserted or removed from said device, wherein said insert contains less than about 5.0% (wt) of compounds having a molecular weight of less than or equal to about 500.

26. A method for removal of an image forming substance deposit in an image forming device containing two opposing surfaces capable of containing said deposit comprising positioning an insert between said surfaces which insert is capable of removing said deposit when said insert is inserted or removed from said device, wherein said insert includes one or more openings to engage a gripping device.

* * * * *